US008806824B2

(12) United States Patent
Schwan

(10) Patent No.: US 8,806,824 B2
(45) Date of Patent: Aug. 19, 2014

(54) WALL CONSTRUCTION AND COMPONENT FOR THE SAME

(76) Inventor: Christoph Schwan, Berlin-Charlottenburg (DE)

( * ) Notice: Subject to any disclaimer, the term of this patent is extended or adjusted under 35 U.S.C. 154(b) by 1863 days.

(21) Appl. No.: 10/518,369

(22) PCT Filed: Jun. 19, 2002

(86) PCT No.: PCT/EP02/06787

§ 371 (c)(1),
(2), (4) Date: Dec. 17, 2004

(87) PCT Pub. No.: WO04/001148

PCT Pub. Date: Dec. 31, 2003

(65) Prior Publication Data

US 2005/0257467 A1 Nov. 24, 2005

(51) Int. Cl.
*E04B 1/74* (2006.01)

(52) U.S. Cl.
USPC ..... 52/407.1; 52/506.01

(58) Field of Classification Search
USPC ..... 52/407.1, 408, 446, 506.01, 561
See application file for complete search history.

(56) References Cited

U.S. PATENT DOCUMENTS 2,102,756 A 12/1937 Smith et al.
2,298,319 A * 10/1942 Vatet ..... 52/232
2,856,766 A * 10/1958 Huntley ..... 52/318
3,999,349 A * 12/1976 Miele et al. ..... 52/568
5,529,624 A * 6/1996 Riegler ..... 106/675
6,397,554 B1 * 6/2002 Kotrotsios ..... 52/741.4

FOREIGN PATENT DOCUMENTS

DE 35 30 973 A1 3/1987
DE 100 62 001 A1 7/2002
EP 1 001 105 A2 5/2000
GB 2 054 004 A 2/1981

OTHER PUBLICATIONS

Saalfeld: English translation of DE 3,530,973.*
"Masonry." The American Heritage® Dictionary of the English Language, Fourth Edition. Houghton Mifflin Company, 2004. Mar. 19, 2008. <Dictionary.com http://dictionary.reference.com/browse/masonry>.*

* cited by examiner

*Primary Examiner* — Branon Painter
(74) *Attorney, Agent, or Firm* — Roberts Mlotkowski Safran & Cole, P.C.; David S. Safran

(57) ABSTRACT

The present invention relates to a wall construction for an exterior brick wall of a building, comprising a rear brickwork and a front brickwork, which is characterized in that the front brickwork (2) is made at least in part of constructional elements (11), particularly bricks, building blocks and the like, which at their side facing the rear brickwork (5) are designed to be reflective for heat radiation. The invention further relates to a constructional element, in particular a brick, a building block or the like, for use in the production of the front brickwork of such a wall construction which on the side which in the walled-in state faces inwardly, is provided with a layer (8) which is reflective for heat radiation.

11 Claims, 2 Drawing Sheets

WALL CONSTRUCTION AND COMPONENT FOR THE SAME

The present invention relates to a wall construction for an exterior brick wall of a building, comprising a rear brickwork and a front brickwork, as well as to a constructional element for such a wall construction.

For a better understanding of the present invention the attached FIGS. 2 to 7 show cross-sections of a hitherto used brickworks and also of construction types of brickworks with reinforced insulation layers.

Figure 2:
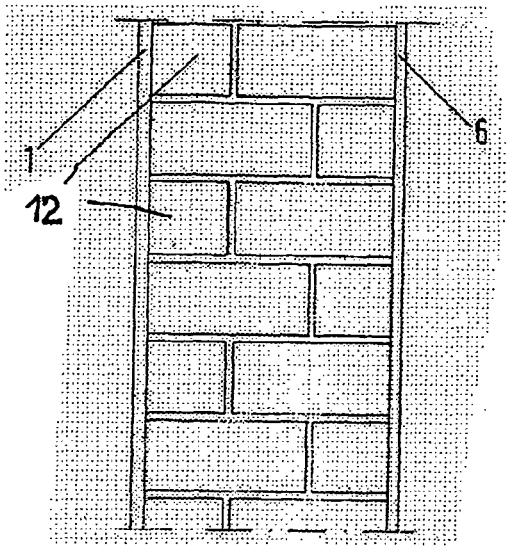

The wall cross-section according to FIG. 2 shows a one-layer brick wall made of common bricks 12, for example clay bricks or lime sand bricks. The brick wall has a usual thickness of 36.5 cm and is covered on both sides with plaster 1 (exterior plaster) and plaster 6 (interior plaster), respectively. The wall construction thus combines supporting and facade-technical functions. With regard to the constructional physic, the dew zone is located in the interior region of the wall cross-section, depending on the indoor climate conditions, the operating heating system and the weather conditions. There condensate is formed and a measurable moisture penetration of the construction material occurs with a corresponding increase of the coefficient of thermal conductivity. The water which can form droplets capillarily moves to the exterior wall and is more or less fast dried in dependence from wind velocity and relative humidity of the exterior air. Under favorable conditions the dew zone forms on the interior of the wall or directly behind it so that condensate is formed also on the indoor side, accompanied by all the concomitant phenomena such as for example the formation of mold ("aspergus niger"). Such constructional damages quasi always occur when on the interior surfaces of such exterior walls heat insulating materials, also furniture or paintings are set up, because they displace the dew zone inwardly. With a per se homogeneous construction the heat insulating capacity depends on the thickness of the brick wall and on the humidity condition. A normal wall of this construction of solid bricks does not attain the required insulation capacity, so that the brick industry for already quite some time produces bricks with a high porosity. Brick walls of such a design attain the required minimum insulation values, however, to the detriment of the storage capacity.

The wall construction according to FIG. 2 absorbs well the incoming solar energy. In the dew water zones that are penetrated by moisture the solar energy even is transported particularly well. In this respect it is a good and well proven wall construction, which, however, does not meet any longer the requirements of the future energy saving regulations (EnEV).

Figure 3:
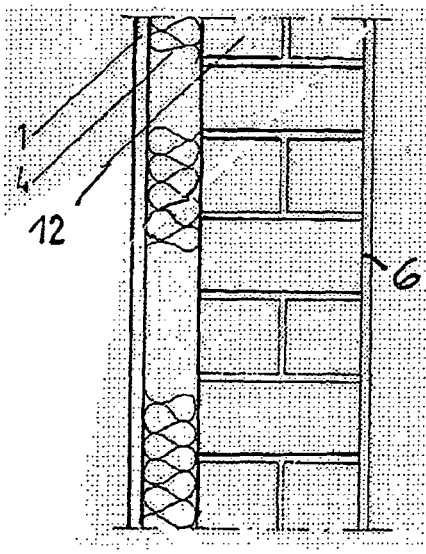

The wall construction shown in FIG. 3 corresponds to the one of FIG. 2 with the exception that on the exterior side it has an insulation layer which usually has a thickness of about 80 mm, which is mechanically fixed at the brickwork. The exterior plaster 1 is, in particular, a synthetic resin plaster which is reinforced in various ways, for example, with a PVC web. As the insulating effect of this construction is largely effected by the insulating material, the wall thickness is reduced to the statically required thickness of 24 cm.

In the wall construction according to FIG. 3 static and insulating functions are distributed to two different layers of construction material. As a general rule, the dew zone in this construction is located in the front third of the insulating layer 4. The water which there has achieved a state in which in can form droplets is capillarily conducted to the exterior surface of the insulating layer from where it is dried off by the air passing by. The exterior insulation leads to a delay in the passage of the thermal energy, which results in that the cross-section of the supporting brick wall remains in a substantially higher energy state.

Insolating solar energy nearly directly impacts onto the insulating layer 4 where it is prevented from further ingress into the wall construction. The exterior thin plaster layer 1, which is about 5 mm thick is warmed up, however, due to its low absolute heat storage capacity cools down very fast. During insulation periods the heating due to insulation also increases to a desirable extent the drying out of the insulating layer 4. This construction is very disadvantageous with dark colors or colors that highly absorb solar energy, because the resulting considerable temperature-induced strains may lead to fissures in the plaster layer 1. The manufacturers of these insulation systems therefore correctly recommend not to utilize dark colors. Altogether this wall construction is almost completely shielded against the gains caused by insulation.

In this type of construction lately construction damages became known, which are caused by the high cooling-off of the surfaces due to loss of thermal energy, wherein due to the insulation layer only little thermal energy is conducted to the surface. The surfaces which have been cooled to a large extent turn into a condensation layer for the exterior air. Therefore they become humid by condensation water or fog up with frost. This leads to algae growth on the surfaces and to the wetting of the insulating material.

In summary it is to be noted that the wall construction according to FIG. 3 is an approved wall construction in which, however, insolating solar energy is shielded off in an unfavorable manner. The heating of respective buildings is exclusively effected by the heating system, which in terms of power consumption is disadvantageous.

Figure 4:
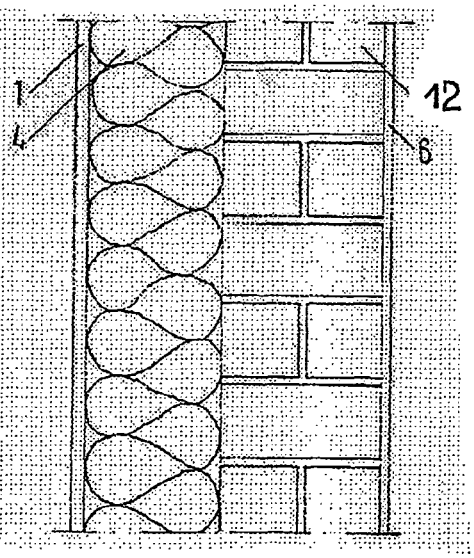

The wall construction according to FIG. 4 corresponds to that of FIG. 3, however, according to the new energy saving regulations EnEV has a considerably thicker insulation layer 4, the recommended minimum thickness of which is 20 cm. The technical function, on principle, is the same as in FIG. 3. However, it is possible that static problems arise due to considerable higher weights in the insulating layer 4 and substantial cantilever moments in the fixings therefore.

In terms of construction physics, by increasing the thickness of the insulating layer 4 a considerable reduction of the thermal transfer is attained by calulation. The design according to FIG. 4, however, implies high risks for damages because the thickness of the insulation which is in front of the dew zone cannot be overcome by the capillary pressure any more. With insulating materials of polystyrene anyway the capillary conductivity is very low due to the structure of the material. Due to the structure of fibrous insulating materials a capillary conductivity in these materials generally is possible only in parallel to the exterior wall surface. Therefore, this construction can only be applied when insulating material is used which is impervious for vapor, for example, double layer foam glass plates in adhesion technique with additional mechanical fixing. The zones into which moisture has penetrated no longer can serve as insulation zone. The further ongoing process leads to a complete wetting of the insulation material. Such a construction is only conceivable for a case in which effective moisture barriers are arranged in front of the insulating material. Such moisture barriers, however, prevent water vapor diffusion through the wall, which popularly is known as "breathing" of a wall.

Even in connection with the indispensable moisture barriers the wall construction according to FIG. 4 is also problematic in a humid warm summer climate with inverse temperature and vapour pressure gradient, because condensation water will build up on the interior surface of the insulating material. Then the moisture barrier located there—because in terms of construction physics it then is on the exterior—is a source of construction damages.

As far as the solar energy is concerned, due to the increased insulating material thicknesses the unfavorable effects already described in the construction according to FIG. 3 occur even stronger. Additional construction damages may result because—as long as the insulating layer 4 is not already totally wetted—the exterior layer 1 cools down by irradiation far below the outside ambient temperature and thus becomes a dew zone for the outside air in winter. Frost is formed and subsequently the exterior layer is wetted. When the vegetation starts to grow early in spring moss and algae will grow on the wetted surfaces with subsequent results in a destruction of the exterior shell. Altogether, the solution according to FIG. 4 is to be considered as a misconstruction prone to constructional damages and involving considerable costs, the application of which—despite the requirements of the ENEV leading to it—has to be strongly discouraged from.

Figure 5:
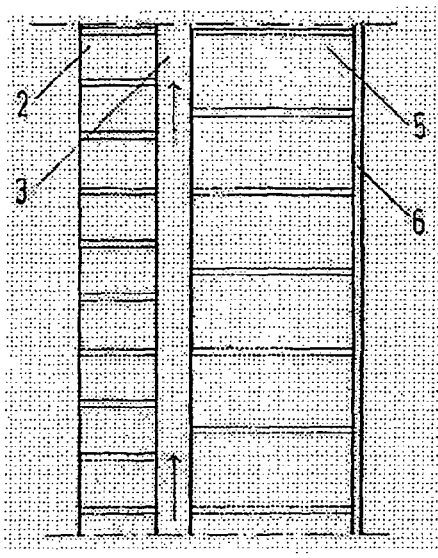

FIG. 5 shows a further traditional wall construction consisting of a supporting brickwork construction 5 of clay bricks or lime sand bricks or other stonework materials, such as concrete. The brickwork 5 in most cases has a thickness of about 24 cm and it has a plaster layer 6 on the indoor side. In front of this wall 5 there is located a flowing air layer 3 with a thickness of about 5 cm. The weather layer consists of a usually about 11.5 cm thick visible wall construction of front wall bricks or other front wall material which is similarly suited. The rear brickwork 5 constitutes the exterior supporting wall of the respective building and has mostly static functions. The flowing air layer 3 serves to dry off condensation water in the front wall cross-section which capillarily reaches the exterior surface of the wall. The front brickwork layer 2 serves as facade and weather shell.

As far as the construction physics is concerned, water vapor diffuses from the indoor side into the cross-section of the supporting wall. This water vapor transforms by condensation in the dew zone into water which may form droplets, wherein the condensation heat resulting therefrom slightly displaces the dew point towards the exterior wall zone. From there the water capillarily moves towards the outside to the air layer 3 and dries off there. Water moving inwardly again retransforms into water vapor.

In terms of heat insulation the wall construction according to FIG. 5, assuming the use of conventional heating systems, does no longer meet the current heat insulation regulations. In the calculation of the thermal transfer merely the plastered inner shell 5 is included. The air layer 3 and the front brickwork 2 already are regarded as exterior zone. The radiation energy from the sun is received by the front brickwork 2 so that it will warm up also in winter under favourable conditions. The flowing air layer 3, however, dissipates a part of the thermal energy. A thermal transfer by convection between exterior shell 2 and inner wall 5 does only take place to a negligible extent. A portion of the absorbed solar energy, however, is transmitted from the exterior shell 2 to the inner wall 5 by radiation and thus reduces the temperature gradient between the indoor surface and the exterior surface of the supporting wall layer. With regard to the energy take up from insulation the heat storing capacity of this wall construction is moderate.

On principle, FIG. 5 shows a good wall construction, which preferably is utilized in regions of Northern Germany that are close to the coast. It, however, does not meet the requirements of minimal heat insulation and it is completely inadmissible under the new EnEV.

Figure 6:
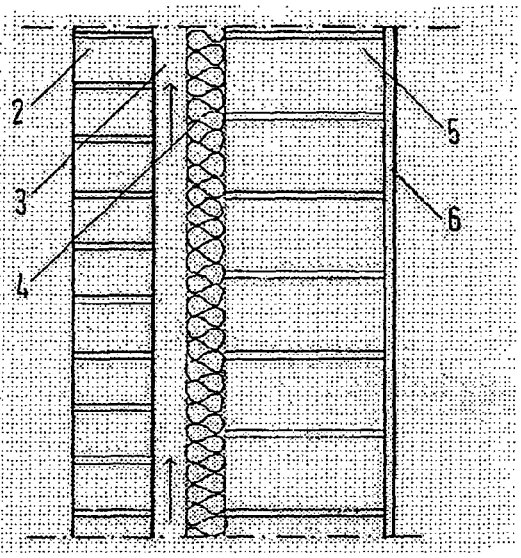

FIG. 6 shows a wall construction which meanwhile is widely used, in which there is a, for example 24 cm thick, supporting inner wall (rear brickwork) 5 in front of which there is provided an insulation layer 4, a rearward venting zone 3 and a, for example 11.5 cm thick, weather shell made of front bricks 2. In terms of construction physics this wall construction can be evaluated similarly as the construction according to FIG. 3. The front brickwork layer 2 is not evaluated with regard to heat aspects. It can be replaced by any other type of facade which is vented at rear and is put up in front. In respect of solar radiation there are only minor differences compared to the wall construction according to FIG. 3. It is a good wall construction with sufficient heat storage and sufficient insulation capacity, which, however in accordance with the future EnEV will be regarded as insufficient.

The rear brickwork 5 mainly serves static functions. Since a 24 cm thick brick or lime sand brick wall does not offer sufficient heat insulation, the rear brickwork 5 of the construction according to FIG. 6 has to carry an at least 60 mm thick insulating layer at its side facing the front brickwork 4, in order to meet the requirements of the DIN 4108. In the example shown there is a 50 mm wide air gap 3 between the insulating layer 4 and the interior side of the front brickwork 2 so as to vent at rear the front brickwork 2. At 6 there again is indicated an interior wall plaster.

Such a conventional wall construction is based on the standardized requirements for heat protection in the field of structural engineering. The standard (DIN 4108) is based on the perception of a "thermal stream" and therefore the standardized insulation technique tries to increase the insulation capacity of the wall construction in itself by building-in material with a low thermal conductivity. This works quite well with a correct dimensioning of the insulation materials. In the course of the development of DIN 4108, which at first was intended to prevent damages by condensation water, a change of meaning has occurred. For years the standard aims more and more at saving of energy. Consequently over the years the minimum thickness of the insulating layers were continuously increased in the standard.

Figure 7:
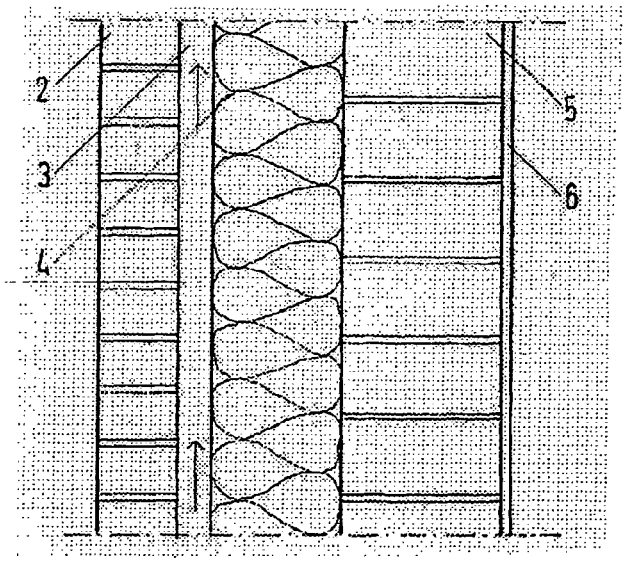

A new standard at present under preparation (the already above mentioned EnEV) provides for 20 to 30 mm thick insulating layers 4, as it is shown in FIG. 7, in combination with air-tight buildings (without venting via windows) and the installation of air conditioning systems.

Arguments against the conventional wall construction, in particular for larger insulating thicknesses, are that the standardized calculation of the passage of water vapor (diffusion) consistently show that the dew zone, i.e. the region in which diffusing water vapor becomes water which may form droplets, as a general rule occurs in the front third of the insulating material. Thus a wetting of the insulating material takes place there, which reduces the insulating effect. With the hitherto utilized insulating layer thicknesses of 6 to 10 cm the dew point is at a distance of 2 to 3 cm to the exterior surface. The remaining distance can be surpassed by the water via capillary conduction. In this wall construction venting at rear is required to remove the moisture. To this end an air layer of at least 50 mm thickness has to be provided, which is to be designed in such a manner that air—as in a chimney—continuously flows over the insulating layer and thus excess moisture that has moved to the surface of the insulating layer due to capillary effects is removed by the air stream and is transported to the outside. To this end it is required to provide inlet and outlet apertures in the front brickwork. The drying effect thereof, however, is only guaranteed, when the air has a relative humidity of less than 70% and moreover flows over all parts of the insulating material surface.

For constructional reasons drying of all surfaces of the insulating materials is possible only in rare cases. In most cases the conditions of flow and buoyancy are not clarified. In particular, the air flow is interrupted by windows or similar structures so that in the concerned zones the insulating material is continuously wetted. In this construction a considerable part of the thermal energy is lost by radiation against the front brickwork, because the usual insulating materials only slightly counteract the heat radiation. The thermal energy received by the front brickwork by radiation is also carried off by the air flowing through air gap 3.

When considering the conventional structure under the aspect of insulation gains from sunlight during the heating period, the built-in insulation material proves to be very disadvantageous because it impedes the energy flow from outside to inside. Moreover, the flowing air layer by convection withdraws the insulated energy from the front brickwork, before it benefits to the rear brickwork.

Furthermore it is problematic that the insulation material has to be fixed with utmost care, because venting at rear on the side of the supporting wall impedes the insulation effect of the insulation material. The carefulness of the craftman's work which is required cannot be checked because the construction is masked.

Already in the arrangement according to FIG. 6 also the great wall thickness of 48 cm is very disadvantageous with regard to the cost effectiveness of a building (loss of habitable area). Furthermore the very cost intensive connection details at apertures in the brickwork are disadvantageous. The venting at rear in the region of the apertures in the brickwork is difficult to implement. Here, too, there is the risk of a growth of vermins in the humid environment between front brickwork and supporting wall, in particular via the air inlet apertures at the root point of the front brickwork.

In thicker insulation layers of 20 to 30 cm thickness (FIG. 7), as they are required in the future, the layer thickness before the dew zone already is 8 to 10 cm. This distance cannot be overcome by the water any more. The water thus remains in the insulating material, where it wets the region of the dew zone. The thus wetted zone becomes ineffective as insulation layer. It turns into the contrary of a heat insulation, i.e. becomes a zone of increased heat transmission. In the thus building up further process the dew zone moves still further inwardly and finally reaches the wall cross-section. The wall is wetted, what is a source of considerable damages to the construction. As soon as within the insulating material a more or less complete water layer has formed, it acts as a moisture barrier which results in a standstill of the water vapor diffusion that still had worked until then. Furthermore, the thickness of the brick wall construction leads to considerable losses of habitable and usable space due to the then much larger insulating layer, which in many cases renders such a construction uneconomic. It is not clear, whether in this construction an air layer thickness of 5 cm is still sufficient.

Furthermore, it has to be considered that insulating materials cannot store heat energy to an appreciable extent. The required thermal capacity is lacking. At a thickness of the insulating layer of between 8 and 12 cm—according to experiences made so far—the above described damages do not occur yet. However, the here still effective insulation becomes notable in so far as the energy deficit occurring due to radiation and lacking heat supply, leads to a decrease of the surface temperature to clearly below the temperature of the ambient air. Thus the surface of the insulating layer becomes the condensation surface vis-à-vis the outside air. In cold and cloud-free winter nights therefore frost formation with subsequent wetting of the wall surfaces occurs. Growth of moss and algae is inevitable. Lately, in the technical literature frequently—with increasing thickness the of insulation layer—reports on such damages appear.

In addition, the human being needs for his well being and to maintain his health a air supply which contains sufficient fresh oxygen. According to the rules of construction techniques this is obtained by a regular air exchange once every hour. Due to random leaks in the window region this air exchange so far was more or less guaranteed. In an air-tight building, as it is requested according to the present consultant's draft of the Federal Housing Ministry (EnEV 2000), this, however, only is conceivable in connection with air conditioning systems. Such devices work with a fresh air admixture of 20 Vol. % per hour so that the fresh air supply is fivefold reduced. The oxygen content of the indoor air therefore is correspondingly low. Recent studies show that in such air conditioned rooms a dramatic increase of radon exposure can occur. There are also investigations showing that inhabitants of such rooms more than average suffer from diseases of the respiratory tract.

Obviously the attempt to save energy by using thicker insulation layers in connection with an air-tight closure of the building therefore implies considerable disadvantages. The arrangement according to FIG. 7 therefore has to be objected. It is a wall construction which will hardly be implemented, although it completely fulfils the requirements of the future EnEV. An economically oriented constructor will not accept a wall thickness of 62 cm (minimum thickness). Furthermore there are almost insolvable problems in the case of a fire if the insulating material catches fire. An insulating layer made of foam glass is out of question for cost reasons. On the whole, this solution is an uneconomic misconstruction with a high susceptibility for construction damages.

It is an object of the present invention to provide a wall construction for brick exterior walls of buildings, which with relatively little required space not only provides for a sufficient heat insulation of the building at a relatively low outdoor temperature but which moreover enhances an exogenous energy influx as well as reliably prevents construction damages which are caused by wetting of the wall construction due to the formation of condensate.

According to the invention, starting from a wall construction for an exterior brick wall of a building, comprising a rear brickwork and a front brickwork, this object is solved by constructing front brickwork at least in part of constructional elements, particularly bricks, building blocks and the like, which only at their side facing the rear brickwork are designed to be reflective for heat radiation.

A constructional element, in particular brick, building block or the like, for use in the production of the front brickwork of such a wall construction, in accordance with the invention, is provided only on that side which in the walled-in state faces inwardly, with a layer which is reflective for heat radiation.

The invention is based on the perception that the above described conventional wall construction only takes into account the problem of the thermal transfer within the construction materials, because the "k-factors" (heat coefficients in $W/(m^2 \times ° K.)$) mentioned in the standard only give information on the transfer of thermal energy within the construction material. Energy losses, however, do not occur due to energy transfers within the construction materials but exclusively due to the fact that thermal energy is emitted to the environment. It, however, cannot be deduced from the k-factors how the energy transfer from an exterior wall to the environment takes place and is not the subject of the relevant standards.

It was now asserted that the loss of thermal energy to the environment to a large extent (approximately 85%) occurs by emission of electromagnetic waves in the infrared range. The by far smaller portion of the thermal transfer to the environment comes about by convection, i.e. by direct transfer of the kinetic energy contained in the particles to air particles flowing by. The extent of this thermal transfer varies in dependence from the wind velocities and from the moisture condition of the wall surfaces and the air flowing by.

The passage of heat through construction material up to the exterior layers may be tolerated, if it is possible to return the there emitted energy back into the building. In the present invention the latter is achieved by the inventive construction of the front brickwork at its interior side. Because electromagnetic waves in the infrared range, on principle, behave as does visible light, they can be reflected in the same manner as these.

Although one could envisage to include in a multi layer brick wall construction reflecting layers in the form of high-gloss aluminum foils or of plastic foils vacuum-metalized with aluminum as they are already on the market. The installation of such foils, however, on the rule is impossible already due to constructional problems but also for the reason that such materials would be highly undesirable diffusion barriers.

In contrast thereto, according to the invention, constructional elements of the front brickwork itself, in particular clay of lime sand bricks for the front brickwork, but also bricks of the front brickwork provided for a subsequent plastering, or other materials used for front brickworks in brickwork technique are designed to be reflective for heat radiation at the side facing the rear brickwork, preferably by being provided with a reflecting layer, for example, of vacuum-metalized aluminum or other materials with reflecting properties. Such constructional elements (bricks) can be walled-in in the usual manner, wherein the moisture diffusion is guaranteed via the joints, in particular mortar joints, of the front brickwork.

In the wall construction according to the invention the thermal energy coming from the interior and being radiated to the exterior is reflected for its mayor part into the warmed cross-section of the wall construction. This applies both to front brickworks which are vented at rear as well as to front brickworks which are attached by mortar, because the back filling mortar, due to its porosity, hardly impedes the reflection effect. Additional insulating layers thus become superfluous. If they nevertheless shall be utilized, they may be kept very thin.

As is well known, in a wall construction built with fully filled joints driving rain intrudes up to a depth of about 60 mm. In this case the driving rain therefore does not reach the reflection layer in a front brickwork having a thickness which exceeds 60 mm, so that it therefore does not have any influence on the drying behaviour of the front brickwork.

In case of a less well built construction driving rain may penetrate the front brickwork via holes in the mortar joints. In the extreme case therefore downward flowing water will form on the interior side of the front brickwork. Such water will, however, not reach the cross-section of the rear brickwork, which is located behind thereof and preferably is separated therefrom by an air layer. It only has to be ensured—as is done already now—by means of usual and established constructions that this water can flow to the exterior again, for example, at the wall base.

The insulation gains from the sunlight also in winter are considerable. They are not appreciably reduced even by the, for thermal radiation, reflective construction of constructional elements of the front brickwork, for example, by metallizing of an aluminum layer. A reflection of the insolated energy back into the front brickwork is not possible, because between the reflecting layer and the rear brickwork no light waves can develop. For this at least the wave length of infrared light would be required. On the other hand, the emission of the thermal energy may possibly only be slightly reduced due to the fact that bright metallic surfaces are bad emitters.

The utilization of a wall material front brickwork which is reflecting only on its interior side leads to a sufficient heat insulation also in the conventional wall construction. Thus, this approved construction type having brought about very satisfactory architecture can also be used in the future. This undoubtedly is of considerable economic importance for the brick and lime stone industry.

In the following embodiments of the invention are described with reference to the enclosed drawings. In the drawings FIG. 1 shows a cross-section through a wall construction according to the invention, FIGS. 2 to 6 show cross-sections for various embodiments of conventional wall constructions, and FIG. 7 show a cross-section through a wall construction according to FIG. 6, which, however, in view of the future energy saving regulations (EnEV) is provided with a thicker insulation layer.

Figure 1:
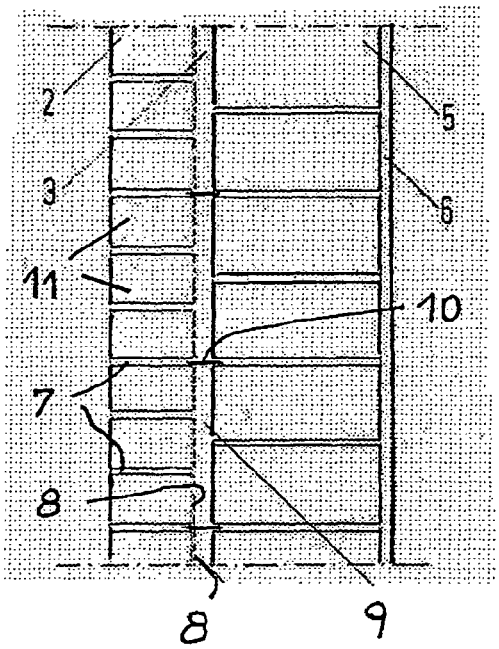

The embodiment shown in FIG. 1 for the novel wall construction of an exterior brick wall of a building comprises a supporting rear brickwork 5 made of common bricks, which usually have a thickness of about 24 cm. However, on principle, also thinner reinforced concrete walls and the like can be used. Furthermore, the wall construction comprises—analogous to the conventional wall construction according to FIG. 5—a front brickwork 2, which in the shown example, has a thickness of about 11.5 cm. An insulating layer corresponding to the insulating layer 4 of the known embodiments according to FIGS. 3, 4, 6 and 7 is omitted. Between the exterior side of the rear brickwork 5 and the interior side of the front brickwork 2 there are air chambers 9 having no inlet or outlet apertures. In the shown embodiment the air chambers 9 have a thickness of approximately 30 mm and are separated from each other by vertical bars 10 which bridge the space between the front brickwork 2 and the rear brickwork 5, in order to suppress circulation of air. Within the air chambers 9 an air layer forms that in general is not moving. This stationary air layer acts as a very good insulating layer and it replaces the insulating materials used so far in this region. Again, an interior side plaster is indicated at 6.

The front brickwork 2 is made of constructional elements 11, which preferably are bricks or lime sand bricks, however, for example, also natural or artificial stone plates, fiber-cement plates, plastic panels or the like. Coursing joints and butt joints, in particular mortar joints are indicated at 7. The constructional elements 11 of the front brickwork 2 are coated with a layer that is reflective for heat radiation exclusively at their interior side, for example, with a reflection layer 8 of vacuum-metalized aluminum.

The entire wall construction according to FIG. 1 is bricklaid in the usual manner. At first the rear brickwork 5 is built. The front brickwork 2 is set up in a second work step using an exterior scaffolding. In order to prevent staining of the high gloss finished reflection layers 8, it is advisable, during bricklaying of the bricks of the front brickwork, to use in the space between the front brickwork 2 and the rear brickwork 5 a soft plate, for example, a mineral wool plate, that is to be drawn upwards corresponding to the progress of the work.

The present wall construction is based on the perception that the emission of thermal energy of a wall mainly is effected by emission in the infrared range of the electromagnetic wave spectrum, that this emission may be reflected by glossy layers, preferably metal layers, that air is completely permeable for radiation and that furthermore stationary or hardly moving air layers constitute the by far best insulating material against an energy transfer from particle to particle. Furthermore this wall construction type takes into account that electromagnetic waves can only develop in regions with a minimum extension of the length of a light wave, but not between closely connected materials such as the interior side of the constructional elements 11 of the front brickwork and the reflection layer 8 fixed thereupon.

The stationary air layer established in the air chambers 9—a venting at rear is not necessary here—thus has the effect of a highly effective insulating layer. According to the standard, this air layer already has a heat transfer resistance of 0.17 ($m^2 \times K/W$). Because from the standpoint of constructional aspects a stationary air layer due to its small mass nearly completely impedes a heat transfer by transfer of kinetic thermal energy, the wall construction described here is quasi "energy-proof" in terms of this process. With a stationary air layer also the front brickwork 2 has an heat insulating and heat storing effect.

The thermal energy having entered into the exterior wall of the building by indoor heating reaches the exterior side of the supporting interior wall 5. The energy arriving there is emitted from there according to the laws of radiation. Here it has to be considered that depending on the energy state of the wall construction at least 85% of the energy emission takes place by thermal radiation. The energy emitted from the exterior surface of the rear brickwork 5 reaches the reflection layer 8 and there it is reflected according to the laws of reflection. According studies on hand a highly glossy aluminum layer is capable of reflecting about 80% of the insolated energy. This portion of the thermal energy thus is completely maintained within the cross-section of the wall construction.

A smaller portion of the interior surface of the front brickwork 2, i.e. the portion of the joints 7 has no reflective coating. There about 10-15% of the energy emitted from the exterior surface of the rear brickwork 5 can penetrate into the front brickwork 2. This little energy introduction into the front brickwork 2, however, is desired, because the outer shell 2 shall not cool-off below the outdoor temperature. There it would then represent a dew zone vis-à-vis the outside air with the disadvantageous effects analogous to the phenomena according to the wall construction in FIG. 4. This application of energy into the outer shell 2 is unobjectionable also because in this wall construction, due to the stationary air layer, also the front brickwork can be regarded as insulating layer. This characteristic of the front brickwork thus sufficiently compensates for the initial energy loss via the wall joints 7. On the other hand, the moisture permeable wall joints 7 of the outer shell 2 allow for the necessary moisture balancing between interior wall 5, air layer 9 and front brickwork 2. The entire wall construction therefore is open to diffusion. This is of such a large importance, because the dew zone of this wall construction, depending on the weather and heating conditions, either is positioned within the stationary air layer or in the front brickwork.

As due to the almost complete retention of the thermal radiation energy from inside in combination with the stationary air layer and due to the insulating co-effect of the exterior shell there is a considerable improvement of the insulation capacity of this layer construction, it is possible to completely refrain from utilizing insulating layers 4 in the constructions of FIGS. 2, 4, 6 and 7. This results—in addition to a reduction in wall thickness, that involves a considerable gain in habitable and usable space—in considerable savings of construction costs in an amount of the insulating materials saved (at present about EURO 13,—to EURO 30.—per $m^2$ wall surface). This cost saving clearly offsets the higher costs for a reflecting coating on the inner side of the front brickwork 2. It is to be noted that the air layer between the interior shell and the exterior shell of the wall construction may be provided stationary, because in this wall construction no insulating material is built in and therefore there is no need to vent and dry an insulating material.

A calculation of the coefficient of heat transfer (k-factor) for the present wall construction without consideration of the described reflection effect results according to the calculation method of DIN 4108 in a value of 0.876 $W/(m^2 \times K)$. This value already is considerably lower than the value required according to the applicable energy saving regulations of 1.56 $W/(m^2 \times K)$, i.e. is about half of the admissible value. If one considers in this calculation also the gains by heat return from the reflection layer and conservatively takes for this a factor of 0.40, then the so-called "k-factor" is reduced to a value of $$0.40 \times 0.876 = 0.350\ W/(m^2 \times K).$$

This value exactly corresponds to the maximum requirement of the new ENEV. It has to be pointed out in this context, that this excellent result is obtained without utilization of insulating materials.

Furthermore the present construction is considerably more advantageous with regard to the insulation gains from sunlight, because these can act via irradiation from the outer shell 2 through the air layer 3 on the rear brickwork 5 substantially unimpeded by the outer shell 2.

The radiation energy from the solar light primarily warms the front brickwork 2 so that it will be warmed up substantially above the ambient temperature also on clear sunny days in winter. With the usual wall construction materials for front brickworks, the latter is evenly warmed after about 2 hours of insulation. Then the front brickwork 2 in turn emits—to a small portion by convection in the now becoming somewhat more turbulent air layers in the air chambers 9, to the larger part by emission—the collected solar energy to the rear brickwork 5. Herein the following effects are to be observed:

The air layer within the air chambers 9 is no obstacle for the transmission of the thermal radiation. Therefore it has no impact on the process of radiation.

Similarly, the reflection layer 8 does not impede the emission, because it is positioned closely to the back side of the brick of the front wall and thus a reflection into the front brickwork 2 is impossible. However, it has to be taken into account that the reflection layer 8 on the rule is a relatively poor emitter, so that the emission process towards the rear brickwork 5 is slightly delayed. This effect, however, is desired, because it accords with the very good thermal capacity of the brickwork.

Herein it is also positive and compensating, that with a warming of the front brickwork 2 condensate stored there evaporates into the air layer of the air chambers 9, whereby the thermal conductivity of this air layer in this phase has the effect from the humid adiabatic behaviour of the air that it accomplishes the energy transmission from outside to inside better than dry air.

The wall construction according to the invention represents a revolution in the art of conventional wall construction, because here for the first time physical effects and phenomena are logically implemented in a construction, in which in particular the correct conclusions are drawn from the fact that the major part of the energy emission from a wall is not determined by the thermal conductivity of the construction materials, but by the emission of electromagnetic waves in the infrared range.

With additional expenses, that are to be considered as minimal and which essentially consist in providing the construction materials for the front brickwork with a reflection layer, with the simultaneous omission of expensive insulating materials, the approved conventional wall construction methods can be continued more economically than heretofore and can thrive again, despite the further limiting regulations of the future EnEV. Without this invention the EnEV would have meant the "end" for this construction method.

Another embodiment possible within the scope of the present invention and alternative to the facade covering with reflecting front wall bricks shown in FIG. 1 is the use of thin facade plates, for example, of the ETERNIT AG, which on the back side are provided with reflecting material. A first test series carried out on a north face has shown as a first partial result that such a construction corresponds to a equivalent thickness of the insulating layer of 30 mm hard polystyrene foam and therefore thus the minimum heat protection is obtained, wherein damages by condensate are reliably avoided.

However, decisive for this wall construction is not as much the reduction of transmission heat losses but is the improvement of the energy balance in the course of the heating period, which is determined to a substantial extent by the fact that not only thermal energy is retained in the building but that thermal energy arriving from outside is to the lowest possible extent impeded from entering the outer surfaces. Such effects naturally are to be observed to a larger extent at sun-exposed surfaces of a building, i.e. at the eastern, southern and western sides, and to a small extent at the north sides.

In a thin-walled construction which consist mainly of facade plates with reflecting coatings, wherein the facade plates are fixed to the exterior surface of the wall by means of a suitable substructure and with joint sealing bands in such a manner that it can be regarded as "not vented at rear" , the following effects in building physics occur:

1) Reflection of thermal radiation:

Depending on the respective reflectance of the coating the radiating heat energy coming from inside is retained in the building by surfaces which are in radiative exchange and have differing coefficients of radiation.

2) Insulation by stationary air layer:

The stationary air layer impedes the energy transfer from inside to outside due to its low thermal conductivity. Measurements showed a good correspondence with the coefficients of thermal conductivity according to DIN 4108-6.

3) Heat recovery by condensation:

The stationary air layer adapts to a high water vapor proportion. The relative humidity within the air layer in winter is 90% and higher. At the surfaces which for certain periods are not reached by solar radiation, at north faces even always, therefore condensation of water vapor occurs at the reflecting inner surfaces, wherein—similar as in other heat recovery systems in the field of air conditioning systems—the heat of condensation is released, i.e. the amount of energy which at a constant material temperature is consumed exclusively by the change in the state of aggregation from liquid to gaseous, and which in tables is listed for water as 627 Wh/kg, and thus the temperature level in the air gap is increased. Consequently the temperature gradient which linearly determines the energy transfer changes correspondingly.

4) Effects of solar radiation:

Depending on the season and cloud amount the surfaces irradiated by the sun obtain higher or lower insolated amounts of energy which results in a warming of the facade plates beyond the temperature of the outside air. Already in March surface temperatures of more than 40° C. were measured at outside temperatures of about 0° C. In terms of the energy balance one thus has to consider the extent of the heat transfer from outside to inside into the wall construction.

When comparing coated and non-coated facade plates one has to take into account that in depending on the surface color the facade plates are warmed by the absorption of the light which was not reflected. This results in a temperature gradient between the facade plate and the adjacent air layers on both sides. The absorbed energy is removed to the environment in part by convection, in part by radiation. This energy loss has to be accepted. As for thin facade plates a uniform warming of the entire material can be assumed, a heat transfer towards inside is effected which also is desired for improving the energy balance. This depends in part on the temperature difference between plate and wall construction, however, also on the radiation processes between plate and wall.

Herein reflecting coated plates differ from uncoated material. The reflecting layer is a poor emitter, so that thermal energy is reduced only poorly by radiation. Therefore the coated material is warmed up more than the uncoated material. As a consequence the coated plate has a considerably higher temperature difference between the plate and the exterior wall located behind it. Provided that the rooms behind the exterior wall are brought to a room air temperature of +20° C. and that by heat conduction the wall surface has a steady temperature of +10° C., it is well possible that there is a temperature gradient between plate and wall surface of 30° C. and more, even in winter weather conditions. Thus, in the present construction—different from the known solution with facade plates that are not provided with a reflective coating—a temperature gradient from outside to inside occurs with a corresponding energy flow.

In the coated construction—depending on the coefficient of radiation of the reflecting layer—about 20% of the thermal energy are transmitted to the interior by radiation. A further energy transfer takes place via convection, which always occurs when the temperature difference between plate and interior wall becomes substantial. Thereupon the stationary air layer starts to move, wherein one has to assume small turbulences, which generate the convective energy transfer. The energy transfer from outside to inside is enhanced by the increased material wetness in the front peripheral zones of the wall construction which results from condensation during insulation phases. On the whole a self-regulating effect is to be observed within the construction which is caused by the fact that the sum of convectively and radiatively transmitted thermal energy, on principle, is the same. This effect can be established theoretically from the radiation law of Stefan-Boltzmann, and empirically by the perceptions on convective energy transfer, which is characterized in that it potentially increases or decreases with the flow velocity.

The derived formula of the radiation law of Stefan-Boltzmann reads:

$$E=C\times(T/100)^4 \text{ in Watt.}$$

Herein E represents energy, T the absolute temperature in Kelvin, C the coefficient of radiation as partial amount of the Stefan-Boltzmann constant 5,67.

In contrast to stationary air layers, in moving air layers the coefficient of heat transfer "Alpha" in $W/m^2\times K$ in accordance with the usually applied empirical formula is to be increased by a value of $12 \times w^{1/2}$. Herein w is the flow velocity in m/s. In the flow velocities which are common in the field of construction therefore the heat transfer can become up to 50-fold larger than it is assumed for stationary air.

At the end of the insulation the turbulent air layer settles and thereupon again is an effective insulation layer. The advantage of the wall construction according to the invention thus lies in the fact that it improves the energy transfer from outside to inside, however, impedes the energy transfer from inside to outside. That is the basic difference of the present wall construction in comparison to the conventional insulation technique, the advantage of which is to reduce losses in transmission heat from inside to outside, the decisive disadvantage of which, however, is the impeding of the inflow of exogenous energy. Herein it has to be noted that with the time variable change of core heating and transition heating periods the impeding of the exogenous energy inflow by externally mounted insulating layers will deteriorate the year-round energy balance, although the coefficients of thermal conductivity are considerably improved.

In the method of construction described herein the exterior wall surfaces are almost completely equipped with electrically conducting material. This also leads to a certain protection against electromagnetic waves. It was shown that for the widely used mobile phones the reception is considerably worse. In view of the fear, that excessive electromagnetic waves might lead to health damages, it is conceivable that the wall construction according to the invention is also advantageous in this respect.

The invention claimed is:

1. A wall construction for an exterior brick wall of a building, comprising an interior masonry wall and an exterior masonry wall, characterized in that the exterior masonry wall (2) is made at least in part of constructional elements (11) which only at their side facing the interior masonry wall (5) are provided with a heat reflective layer directly thereon, wherein a stationary air layer is formed filling a space defined extending from said reflective layer on the exterior masonry wall to the facing side of the interior masonry wall, the space being otherwise free of insulating materials.

2. The wall construction as defined in claim 1, wherein the constructional elements (11) are selected from the group consisting of bricks, building blocks and facade plates.

3. The wall construction as defined in claim 2, wherein said heat reflective layer is formed of a material which has been vapor-deposited on the side of said constructional elements (11) facing the interior masonry wall (5).

4. The wall construction as defined in claim 1, wherein the constructional elements (11) of the exterior masonry wall (2), at least in regions of their inner side, are coated with a heat reflective layer of aluminum or an aluminum alloy.

5. The wall construction as defined in claim 1, wherein the exterior masonry wall (2) has a thickness of more than 60 mm.

6. The wall construction as defined in claim 1, wherein the exterior masonry wall (2) is made of facade plates which only on their inner side are provided with a reflective coating as said reflective layer.

7. The wall construction as defined in claim 1, wherein said space is subdivided into static air chambers by bars which bridge the space between the exterior and interior masonry walls so as to suppress circulation of air.

8. The wall construction as defined in claim 7, wherein the static air chambers have a thickness of approximately 30 mm.

9. A constructional element for use in the production of the exterior masonry wall of a wall construction for an exterior wall of a building, comprising a rear masonry wall and said exterior masonry wall, said walls being separated by an air gap extending therebetween characterized in that the constructional element, on the side of the exterior masonry wall which in the walled-in state faces inwardly, is provided with a layer of a metal (8) which is reflective for heat radiation directly on the inwardly facing side of the exterior masonry wall.

10. The constructional element as defined in claim 9, wherein said constructional element is an element selected from the group consisting of bricks, building blocks and facade plates.

11. The constructional element as defined in claim 9, wherein said metal is aluminum or an aluminum alloy.

* * * * *